United States Patent [19]

Jackson

[11] 3,993,019

[45] Nov. 23, 1976

[54] APPARATUS FOR COATING A SUBSTRATE

[75] Inventor: Brian W. Jackson, London, England

[73] Assignee: Eastman Kodak Company, Rochester, N.Y.

[22] Filed: June 19, 1975

[21] Appl. No.: 588,260

Related U.S. Application Data

[62] Division of Ser. No. 326,621, Jan. 26, 1973, Pat. No. 3,928,678.

[52] U.S. Cl. ..... 118/50; 118/411

[51] Int. Cl.[2] ..... B05C 5/02

[58] Field of Search ..... 118/407, 411, 412, 50; 96/87 R

[56] References Cited

UNITED STATES PATENTS

| | | | |
|---|---|---|---|
| 2,761,419 | 9/1956 | Mercier et al. | 118/412 |
| 2,975,754 | 3/1961 | Wright | 118/407 |
| 3,627,564 | 12/1971 | Mercier | 118/412 X |
| 3,749,053 | 7/1973 | Timson | 118/412 X |
| 3,916,043 | 10/1975 | Fowble | 96/87 R X |

*Primary Examiner*—John P. McIntosh
*Attorney, Agent, or Firm*—A. P. Lorenzo

[57] ABSTRACT

An improved coating apparatus of the kind wherein a coating hopper having a vertically inclined slide surface is provided, upon which one or more layers of a liquid coating composition(s) may be made to flow in a downwardly-inclined direction into a coating bead or bridge of coating solution which bridge spans a generally horizontal gap between an edge of the hopper and an upwardly moving substrate to be coated. In the apparatus of the invention, a coating composition(s) is made to flow over an upturned surface and toward the substrate, so that the coating composition(s) flows into the bridge of coating solution at an angle of lesser inclination to the horizontal than that of the slide surface. The apparatus of the invention improves upon coating apparatus of the prior art by providing, when coating, increased bead stability and minimizatin of the deleterious effects of particles that lodge at an edge of a coating apparatus.

20 Claims, 3 Drawing Figures

PRIOR ART

APPARATUS FOR COATING A SUBSTRATE

This is a division of application Ser. No. 362,621, filed Jan. 26, 1973, and issued Dec. 23, 1975 as U.S. Pat. No. 3,928,678.

BACKGROUND OF THE INVENTION

1. Field of the Invention

This invention relates to improvements in coating apparatus. The invention is particularly useful in the coating of one or more layers of coating compositions onto a substrate, such as, say, a web.

2. Description of the Prior Art

In the prior art, as represented by U.S. Pat. Nos. 2,761,419, filed in the name of Mercier et al. and 2,761,791 filed in the name of Russell et al.—the contents of which patents are herein incorporated by reference—it is known to simultaneously coat a moving substrate, for example, a web of photographic film base with emulsion coating compositions, by the use of a coating hopper which includes one or more inclined slide surfaces, down which one or more of the fluid coating compositions may be made to flow. The hopper may include a plurality of separate exit slots, whereby respective liquid coating compositions may be metered from individual supplies and distributed uniformly across respective inclined slide surfaces. Each of the respective compositions flows by gravity as a layer down its respective inclined surface, whereby the layer becomes smooth and of uniform thickness. The slide surfaces are arranged so that the layers flow on top of one another. At the end of the last slide surface, i.e., the one adjacent to the substrate, the stratified layers flow into a bead or puddle which bridges a small generally horizontal gap between an edge of the coating hopper and the upwardly moving substrate. The substrate, as it is advanced into contact with the bead, simultaneously picks up all the layers, which layers deposit on the substrate as a composite coating of substantially distinct superimposed layers.

While the above apparatus functions satisfactorily, various defects can arise in the coated layers if the bead is disturbed. For example, a particularly noticeable fault is the appearance of longitudinal striations which render the coated web unacceptable as a commercial photographic product. The presence of these longitudinal striations tends to increase rapidly as the web speed is increased.

Furthermore, as disclosed in the aforementioned patent, and in U.S. Pat. No. 2,681,294—the contents of which are also incorporated by reference—it is advantageous to create a pressure differential between the exposed surfaces of the bead, such as by the creation of a vacuum on the trailing surface of the bead to eliminate excessive vibration and/or rupture of the bead. The range of vacuum levels which may be used is, of course, limited as, if it is too great, the high pressure differential across the bead may also cause the bead to be disturbed and/or ruptured. At times, it may develop that the amount of vacuum being used is insufficient to elimiate the excessive vibration in the bead, and thus it is desirable to increase the amount of such vacuum. Where an increase in vacuum will itself cause disturbance and/or rupture of the bead, it is sometimes necessary to change coating conditions, such as by lowering web speed, to make satisfactory coatings.

A further problem with the use of the coating hopper described in the aforementioned Mercier et al patent is that particles in the liquid coating composition may adhere to the hopper at the lip edge thereof and cause undesirable streaks to be formed in the coating. An apparatus which reduces or minimizes the deleterious effects of such particles on coatings represents a significant contribution to the state of the art.

SUMMARY OF THE INVENTION

It is therefore one object of the invention to provide an improved apparatus for coating a moving substrate at higher speeds with minimum bead disturbance.

It is a further object of the invention to provide an improved apparatus for coating a moving substrate which minimizes the undesirable effects of particles which adhere to a lip of the coating apparatus.

In the apparatus of the invention, a coating hopper is provided with a downwardly inclined slide surface upon which one or more layers of liquid coating composition(s) may be made to flow so the layers become smooth and of uniform thickness. The hopper includes a lip which extends towards the substrate at an obtuse angle relative to the slide surface and the layer(s) of coating composition(s) may flow on this lip before being fed into a bridge of coating solution, which bridge spans a generally horizontal gap between the hopper and an upwardly moving substrate to be coated.

DESCRIPTION OF THE PREFERRED EMBODIMENT(S)

Figure 1:
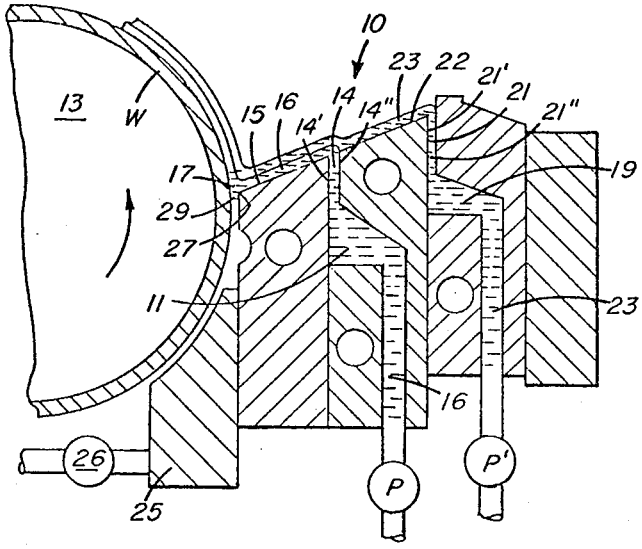
FIG. 1 is a side view, partly in section, showing a coating apparatus including a multiple layer slide hopper as known in the prior art.

In prior art coating appartus, such as disclosed in the Mercier et al patent and shown herein in FIG. 1, a substrate, such as web W, is supported on and advanced past a coating hopper 10 by a driven coating roller 13. The web may be paper, metal or plastic film and may include one or more substantially dry coatings previously applied thereto. For illustrative purposes the hopper 10 is shown as being adapted to coat two layers simultaneously onto the web W although it will be appreciated that slide hoppers are known in the prior art to coat one or more than two layers and the invention is also applicable to such hoppers. Metering pumps, P and P′, are coupled to respective sources of fluid coating compositions and feed the compositions 16,23 at desired rates into respective cavities 11,19 formed in the interior of hopper 10. The compositions 16,23 are each then forced to flow generally vertically as a ribbon through narrow discharge slotes 14,21 respectively, each of which slots at one end extends into the interior of the hopper to a respective cavity 11,19 and at the other end exits onto the upper end of a downwardly inclined planar slide surface 15,22 respectively. The compositions 16,23 are each thus extruded in the form of a liquid layer onto their respective slide surface. The slide surfaces 15,22 in the prior art multiple layer hopper shown in FIG. 1 are substantially coplanar; however, they may be substantially parallel with slide surface 22 raised slightly above slide surface 15 a distance of the order of the thickness of layer 23. The discharge slots 14,21 are each defined by a pair of opposed spaced-apart parallel planar surfaces 14', 14''; 21', 21'' respectively and are arranged so that an exit of the lowermost slot 14 is spaced above an edge 27 of the coating hopper 10. At the exit of the lowermost slot 14, the upper layer 23 flows upon the lower layer 16, whereupon the two layers flow together along the surface 15 in stratified relationship into a bead at 17. The bead 17 spans a generally horizontal gap between the edge 27 and the upwardly moving web W. As used herein a web or substrate is generally upwardly moving at any point where at such point its vertical component of velocity is greater in magnitude than its horizontal component of velocity.

As the web is advanced rapidly past the bead, a surface thereof picks up the layers and the layers deposit onto the substrate as a composite coating of substantially distinct superimposed layers. To stabilize the bead, suction or a vacuum may be employed on the trailing surface 24 of the bead to establish a pressure differential between the exposed surfaces of the bead. The suction may be provided by a chamber 25 which is coupled to a vacuum pump 26 to exhaust air from the chamber 25.

Figure 2:
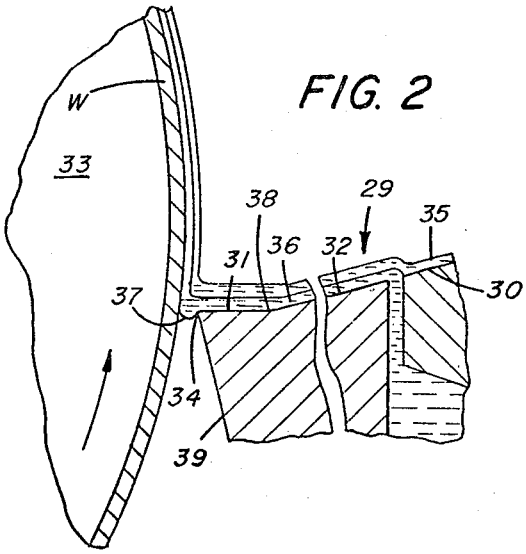
FIG. 2 is a close-up side view of an improved coating apparatus made in accordance with the invention.

In FIG. 2, a portion of an improved slide hopper 29 made in accordance with the present invention is shown. For purposes of clarity the suction chamber has been deleted from FIGS. 2 and 3 but such pressure differential establishing means is advantageous when used in conjunction with the embodiments shown in FIGS. 2 and 3. The slide hopper 29 is similar in most respects to the hopper shown in FIG. 1, but differs in that it includes an upturned lip 31 which extends at an obtuse angle from the lower end of the lowermost slide surface 32 toward the surface of a generally upwardly moving substrate W, e.g., the web, being coated. The lip 31 is preferably generally planar and of the same transverse width as the planar slide 32 and terminates in a transverse edge 34, defined by the planar land of the lip 31 and side face 39 of the hopper. Edge 34 is spaced generally horizontally from the coating roller 33 a distance slightly greater than the thickness of the web W, to be coated so as to establish in operation of the hopper a bead or puddle 37 of liquid coatng compositions. Preferably the gap between edge 34 and the surface of the web being coated is between about 0.005 inches (0.13mm) to about 0.03 inches (0.76mm). As may be noted from FIG. 2, the coating solutions flow down the lowermost slide surface 32 with the uppermost layer 35 on top of the lowermost layer 36. The slide surfaces 30,32 are each inclined relative to the horizontal at a desired angle that is preferably greater than ten degrees and less than 45° depending upon the properties of the composition(s) being coated. As the lip 31 is of lesser inclination to the horizontal than that of the slide surfaces 30,32 the layers 35,36 flow over the lip with reduced speed but increased thickness (depth). The increased thickness of the layers on the upturned lip 31 is advantageous in that the effects of any particles that happen to lodge at edge 34 are minimized by a "dilution" of such effects by the thicker layers on the upturned lip, i.e., a particle of a certain size that is lodged on the edge 34 will tend to create greater disturbances in thin (shallow) layers as opposed to thick (deep) layers as the liquid compositions flow past the particle. The lip 31 is directed in a generally horizontal direction, and is preferably horizontal although it may be inclined relative to the horizontal in the direction of fluid flow within the preferred range of ±5°. The length of the lip 31 in the direction of liquid flow is advantageously in the range of about 0.025 to 0.080 inches (0.06cm to 0.21cm), and is preferably about 0.040 inches C0.10cm). Such dimensions are advantageous in the coating of photographic compositions wherein emulsion coatings might vary between a dry thickness of .0001 – .001 inches and protective layers separating such emulsion layers might be as thin as one micron.

With the use of the coating roller 33 to support the web in a smooth condition it is desirable to have the point of application of the bead to the web W be within a preferred (acute) angular range of "application points" and such preferred range is from about a point on the web that is located at about 40° below the horizontal radius of the coating roller 33 vertically to about 30° above said horizontal radius. The genrally horizontal gap is advantageous in that it allows gravity to act on the suspending bridge of coating solution and facilitates the formation of the bead.

In the prior art apparatus of FIG. 1, one factor which may contribute to the inability of the bead at times to withstand higher pressure differentials is that the bead must, in addition to the pressure differential across it, support itself against the force of the downardly rushing liquid layers which are continuously feeding into the bead.

The introduction of the coating compositions into the bead along the generally horizontal plane of the lip 31 apparently is able to reduce the force of the liquid rushing into the bead or otherwise increase the stability of the bead so that increased suction levels may be used on the bead at high coating speeds without encountering bead disturbance which produces unsatisfactory coatings. Furthermore, even at the same suction levels, increased coating speeds may be obtained using the apparatus of the present invention over that shown in the Mercier et al patent.

To illustrate the advantages of the invention two superimposed layers of gelatin solution may be coated using a coating hopper of the prior art as shown in FIG. 1 and embodying the invention as shown in FIG. 2. The lower gelatin solution may have a concentration of 3.85% by weight and a wet laydown of 1.125 lbs/100 square feet. The upper layer may have a concentration of 6.6% by weight and a wet laydown of 0.303 lbs/100 square feet. Suction may be maintained across the bead during coating with a gap between the lip and the web of about 0.008 inch. With the apparatus of the present invention it was found tht striations due to instability of the bead and which are present with the use of bead coating apparatus of the prior art are absent at high coating speeds.

Figure 3:
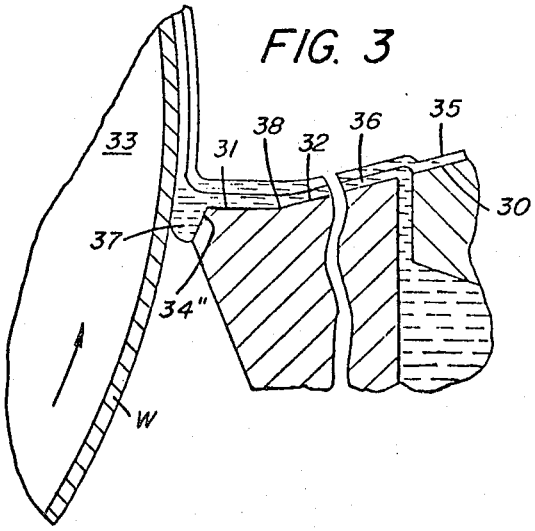
FIG. 3 is a view similar to FIG. 2 showing another embodiment of the invention.

If desired, the transverse edge 34 may be rounded or chamfered to prevent nicks or other damage to the otherwise sharp edge. A coating hopper with such a chamfered edge 34'' is shown in FIG. 3 wherein like numerals refer to parts similar to that shown and described for FIG. 2. Preferably the lip 31 in the embodiment shown in FIG. 3 should be of the same dimension and angular orientation as for that described for FIG. 2. A coating hopper which includes such a chamfered edge 34'' is advantageous in that with the use of such a hopper there is substantially eliminated the formation of streaks in coating, which streaks may be attributed to imperfections in a sharp transverse lip edge.

While the preferred embodiment has been described with respect to multiple layer coating apparatus, the invention may also be used to advantage in the form of a single layer slide hopper wherein a single layer of liquid coating composition may be made to flow down an inclined slide surface, and then along an upturned lip before being introduced into a bead, which bead bridges a generally horizontal gap between the hopper and a generally upwardly moving web. In such a single layer slide hopper the preferred degree of inclination of the slide surface and that of the lip and the preferred length of the lip are within the ranges referred to for the double layer slide hopper. To demonstrate the advantages of the above-described apparatus of the invention, a layer of a 5.55 percent by weight aqueous solution of gelatin was formed on a slide surface, and was coated onto a web with a wet laydown of 1.8 lbs/100 square feet. A differential air pressure was maintained across the coating bead as the layer passed over the edge of the lip of the slide surface. The gap between the lip and the moving web was about 0.005 inch. As compared with results obtained under similar coating conditions using a planar slide surface of the prior art which did not have an upturned lip, it was found that, with apparatus of the present invention, longitudinal striations due to instability of the bead are absent or minimized at coating speeds at which they would occur with the prior art apparatus. Thus acceptable coatings could be made at speeds substantially higher than that using the planar slide hoppers of the prior art.

In its broader aspects, the invention may be embodied as a slide hopper having a curved slide surface(s), such as of the type shown in FIG. 3 of U.S. Pat. No. 2,681,294. However, coating hoppers having planar slide surfaces are preferred, as they are substantially easier and less expensive to machine. In machining the planar land 31 on the lowermost planar slide surface 32, it is desirable to round, as shown in FIG. 2, the obtuse angle 38 formed between the surfaces 31, 32.

The invention is particularly applicable to a multiple layer slide hopper of the extrusion-slide type, as disclosed in U.S. Pat. No. 2,761,417, which may also have a generally upturned lip formed on the slide surface. Such a coating hopper is described in commonly assigned application Ser. No. 327,048 filed Jan. 26, 1973 and issued Dec. 23, 1975 as U.S. Pat. No. 3,928,679 and in commonly assigned application Ser. No. 588,261 filed June 19, 1975 as a division of application Ser. No. 327,048.

The apparatus of this invention can be utilized to coat any material or mixture of materials which can be put in liquid form and bead coated, for example, in the form of a solution, a dispersion, or a suspension. In many instances where this apparatus finds application, the coating composition is an aqueous composition but other liquid vehicles of either an organic or inorganic nature, can also be utilized and are fully within the contemplation of this invention. The respective layers can be formed of the same or different liquid coating compositions and these coating compositions can be either miscible or immiscible with one another.

In addition to use in the manufacture of photographic elements, the apparatus of this invention finds application in many other areas of the coating art, for example, in manufacture of mineral coated paper which requires one or more coated layers in which one or more separate layers of different compositions are desired to impart particular properties to the product.

As indicated hereinbefore, the apparatus of this invention is especially useful in the photograhic art for manufacture of multilayer photographic elements, i.e., elements comprised of a support coated with a plurality of superimposed layers of photographic coating composition. The number of individual layers may range from two to as many as ten or more. In the photographic art, the liquid coating compositions utilized are of relatively low viscosity, i.e., viscosities from as low as about two centipoise to as high as about 150 centipoise, or somewhat higher, and most commonly in the range from about five to about 100 centipoise.

The apparatus of this invention is suitable for use with any liquid photographic coating composition and can be employed with any type of photographic support and it is, accordingly, intended to include all such coating compositions and supports as are utilized in the photographic art within the scope of these terms, as employed herein and in the appended claims.

The term "photographic" normally refers to a radiation sensitive material, but not all of the layers presently applied to a support in the manufacture of photographic elements are, in themseleves, radiation sensitive. For example, subbing layers, pelloid protective layers, filter layers, antihalation layers, etc., are often applied separately and/or in combination and these particular layers are not radiation sensitive. The present invention relates also to the application of such layers, and the term "photographic coating composition", as employed herein, is intended to include the compositions from which such layers are formed. Moreover, the invention includes within its scope all radiation sensitive materials, including electrophotographic materials and materials sensitive to invisible radiation as well as those sensitive to visible radiation. While, as mentioned hereinbefore, the layers are generally coated from aqueous media, the invention is not so limited since other liquid vehicles are known in the manufacture of photographic elements and the invention is also applicable to and useful in coating from such liquid vehicles.

More specifically, the photographic layers coated with the apparatus of this invention can contain light-sensitive materials, such as silver halides, zinc oxide, titanium dioxide, diazonium salts, light-sensitive dyes, etc., as well as other ingredients known to the art for use in photographic layers, for example, chemical sensitizers, development modifiers, antifoggants and stabilizers, developing agents, hardeners, plasticizers and lubricants, coating aids, matting agents, antistatic agents, brighteners, spectral sensitizers, absorbing and filter dyes, color materials, etc. Specific examples of these ingredients may be found in the publication entitled *Product Licensing Index*, Volume 92, Dec. 1971, Publication 9232, pages 107 through 110, and in the publications cited therein. The photographic layers can also contain various colloids either alone or in combination as vehicles. Suitable hydrophilic vehicle materials include both naturally-occurring substances, such as proteins, for example, gelatin, gelatin derivatives, etc., and synthetic polymeric substances, such as water soluble polyvinyl compounds. Further examples of suitable vehicles are disclosed in the aforecited publication.

Various types of supports may be used to support the photographic elements. Typical flexible supports include film base, e.g., cellulose acetate and poly(ethylene terephthalate), paper, metal, etc. Other supports which may be used are also disclosed in the aforecited publication.

It will be appreciated from the above that the invention provides an improved apparatus which may be used to coat a web at increased speeds. It will be further appreciated that such apparatus embodying the invention claimed herein may be made relatively inexpensively by modifying coating hoppers of the prior art without the need even for changing the mountings for such apparatus.

The invention has been described in detail with particular reference to preferred embodiments thereof, but it will be understood that variations and modifications can be effected within the spirit and scope of the invention.

I claim:

1. An apparatus for coating one or more liquid coating compositions onto a surface of a substrate, said apparatus comprising:

means for defining a downwardly inclined planar slide surface upon which one or more liquid coating compositions are adapted to flow as one or more layers respectively before being coated on the substrate;

means for defining an exit opening located adjacent the upper end of said slide surface, through which a liquid coating composition is adapted to pass before being deposited onto said planar slide surface; and means for defining a rigid lip portion which extends from and is continuous with the lower end of said planar slide surface and is adapted to have the one or more liquid coating compositions flow thereon, said lip portion being directed in the direction of liquid flow at an angle of lesser inclination to the horizontal than that of said planar slide surface.

2. The invention according to claim 1 wherein the length of said lip portion in the direction of liquid flow is between 0.025 and 0.080 inches.

3. The invention according to claim 1 wherein said lip portion comprises a generally horizontal, generally planar surface.

4. The invention according to claim 3 wherein said lip portion is oriented in the direction of liquid flow within the range of $\pm 5°$ relative to the horizontal.

5. The invention according to claim 4 wherein the length of said lip portion in the direction of liquid flow is between 0.025 and 0.080 inches.

6. The invention according to claim 5 wherein said apparatus is a multiple-layer slide hopper and further comprises:

means for defining a second downwardly inclined planar surface upon which a second liquid coating composition is adapted to flow as a layer, said second slide surface being generally parallel to the first mentioned planar slide surface and having its lower end located adjacent to the first mentioned exit opening, so that said exit opening is between said first and second planar slide surfaces;

means for defining a second exit opening that is located adjacent the upper end of said second slide surface and adapted to deliver a second liquid coating composition through said second exit opening and onto said second slide surface, wherein at said first exit opening the second coating composition is adapted to flow as a layer upon the liquid coating composition exiting from said first exit slot, whereby the two compositions are adapted to flow down said first planar slide surface, along said lip and onto said substrate.

7. The invention according to claim 6 and including means for supporting said substrate proximate to and generally horizontally spaced from said lip portion and for generally vertically moving said substrate across and into contact with said liquid coating compositions so that the surface of the substrate picks up the layers of liquid coating composition in superimposed substantially distinct layered relationship.

8. The invention according to claim 7 wherein each of said exit openings has associated therewith means defining a narrow metering slot for metering a respective coating composition before said coating composition is deposited on its respective slide surface; and means for defining a cavity into which said respective coating composition may be delivered before being metered through said metering slot.

9. The invention according to claim 5 and including means for defining a rounded edge at the end of said lip portion.

10. The invention according to claim 5 and including means for defining a chamfer at the end of said lip portion.

11. An apparatus for coating one or more liquid coating compositions onto a surface of a substrate, said apparatus comprising:

means for defining a downwardly inclined slide surface upon which one or more liquid coating compositions are adapted to flow as one or more layers respectively before being coated on the substrate;

means for defining an exit opening located adjacent the upper end of said slide surface, through which a liquid coating composition is adapted to pass before being deposited onto said slide surface; and means for defining a rigid lip portion which extends from and is continuous with the lower end of said slide surface and is adapted to have the one or more liquid coating compositions flow thereon, said lip portion being directed in the direction of liquid flow at an angle of lesser inclination to the horizontal than that of said slide surface; and means for supporting said substrate proximiate to and generally horizontally spaced from said lip portion and for generally verticaly moving said substrate across and into contact with said one or more liquid coating compositions so that the surface of the substrate picks up the one or more layers of liquid coating composition in superimposed substantially distinct layered relationship.

12. The invention according to claim 11 wherein the length of said lip portion in the direction of liquid flow is between 0.025 and 0.080 inches.

13. The invention according to claim 11 wherein said lip portion comprises a generally horizontal, generally planar surface.

14. The invention according to claim 13 wherein said lip portion is oriented in the direction of liquid flow within the range of $\pm 5°$ relative to the horizontal.

15. The invention according to claim 14 wherein the length of said lip portion in the direction of liquid flow is between 0.025 and 0.080 inches.

16. The invention according to claim 15 wherein said apparatus is a multiple-layer slide hopper and further comprises:

means for defining a second downwardly inclined planar surface upon which a second liquid coating composition is adapted to flow as a layer, said second slide surface being generally parallel to the first-mentioned planar slide surface and having its lower end located adjacent to the first-mentioned exit opening, so that said exit opening is between said first and second planar slide surfaces;

means for defining a second exit opening that is located adjacent the upper end of said second slide surface and adapted to deliver a second liquid coating composition through said second exit opening and onto said second slide surface, wherein at said first exit opening the second coating composition is adapted to flow as a layer upon the liquid coating composition exiting from said first exit slot, whereby the two compositions are adapted to flow down said first planar slide surface, along said lip and onto said substrate.

17. The invention according to claim 16 wherein each of said exit openings has associated therewith means defining a narrow metering slot for metering a respective coating composition before said coating composition is deposited on its respective slide surface; and means defining a cavity into which said respective coating composition may be delivered before being metered through said metering slot.

18. The invention according to claim 17 wherein said means for supporting said substrate comprises a generally horizontally extending roller about which said substrate is at least partially wrapped, and wherein said lip portion is so located relative to the substrate wrapped on said roller so as to apply said coating compositions onto the substrate at an application point located within the range of application points between about 40° below a horizontal radius of the roller upwardly to about 30° above the horizontal radius of the roller.

19. The invention according to claim 16 wherein said lip portion is adapted to be spaced from the substrate a distance sufficient to permit a bead of the liquid coating compositions to be formed in the gap between said lip portion and the substrate.

20. The invention according to claim 19 and including means for establishing a pressure differential between the exposed surfaces of the bead so that a relatively lower pressure is created adjacent the trailing surface of the bead.

* * * * *